US005711120A

United States Patent [19]

Karpen

[11] Patent Number: 5,711,120

[45] Date of Patent: Jan. 27, 1998

[54] SELF ANCHORING FIRE RESISTANT TWO PIECE NON-OPERABLE WINDOW FRAME ASSEMBLY

[75] Inventor: Joseph Karpen, Weaverville, N.C.

[73] Assignee: Karpen Steel Products, Inc., Weaverville, N.C.

[21] Appl. No.: 677,563

[22] Filed: Jul. 8, 1996

[51] Int. Cl.[6] ..... E06B 1/20

[52] U.S. Cl. ..... 52/212; 52/204.54; 52/217; 52/204.56

[58] Field of Search ..... 52/204.53–204.56, 52/211–213, 208, 217, 204.62, 204.7, 775, 780

[56] References Cited

U.S. PATENT DOCUMENTS

| | | | |
|---|---|---|---|
| 2,561,142 | 7/1951 | Schiessl . | |
| 2,687,194 | 8/1954 | Kelly . | |
| 2,727,597 | 12/1955 | Musgrave | 52/775 |
| 2,777,548 | 1/1957 | Adams . | |
| 2,791,007 | 5/1957 | Kobill et al. . | |
| 2,996,767 | 8/1961 | Kobil et al. | 52/204.54 |
| 3,768,220 | 10/1973 | Riegelman | 52/208 |
| 3,906,671 | 9/1975 | Maldonado | 52/212 |
| 3,969,857 | 7/1976 | Startz . | |
| 4,030,258 | 6/1977 | Anders . | |
| 4,115,964 | 9/1978 | Montrouil | 52/208 |
| 4,126,975 | 11/1978 | Williams | 52/211 |
| 4,128,977 | 12/1978 | Schubais | 52/217 |
| 4,259,818 | 4/1981 | Stark . | |
| 4,897,975 | 2/1990 | Artwick et al. | 52/780 |
| 5,369,922 | 12/1994 | Hansen | 52/204.54 |
| 5,471,803 | 12/1995 | Logan et al. | 52/204.54 |

OTHER PUBLICATIONS

Underwriters Laboratories Standard For Safety Fire Tests of Window Assemblies UL9–6th edition 1994.

Underwriters Laboratories File R13412 Apr. 29, 1988 Project 88 NK5046 Karpen Steel Products Weaverville, N.C.

Underwriters Laboratories File R4373 Mar. 5, 1993 Project 92RT3965 Karpen Steel Products Weaverville, N.C.

Underwriters Laboratories File R4373 Mar. 4, 1993 Project 92 RT 3964 Karpen Steel Products Weaverville, N.C.

Underwriters Laboratories File R4373 Feb. 1, 1996 Project 95 RT 7610 Karpen Steel Products Weaverville, N.C.

*Primary Examiner*—Robert Canfield

*Attorney, Agent, or Firm*—Alfred M. Walker

[57] ABSTRACT

A non-operable window frame assembly comprising two frame sections, each of which slips into a rectangular hole in a wall from opposite sides of the wall; the wire glass or fire resistant glazing material is held in place by means of four pieces of square sugar molding screwed in from the top of the molding; the screws go through both sections of the window frame assembly; holding the entire assemblage in place without the need for anchor clips, making the window frame assembly self anchoring. The size of the glazing material is up to 36"×36". The height of the square molding is a minimum of one inch, making the maximum size of the exposed glazing material 34"×34". The entire assemblage comprising the window frame assembly and wire glass or fire resistant glazing material meets Underwriters Laboratories standards with a fire rating "C" label (45 minutes). The miters of the two from sections are continuously welded at the corners. The window frame assembly can be used for both interior and exterior walls of varying widths. For installations in an exterior wall, the glazing material can be replaced if it is broken from the inside of the building without the need for scaffolding or ladders on the exterior of the structure. The window frame assembly can be manufactured with or without a drywall return.

24 Claims, 4 Drawing Sheets

SELF ANCHORING FIRE RESISTANT TWO PIECE NON-OPERABLE WINDOW FRAME ASSEMBLY

BACKGROUND OF THE INVENTION

1. Field of the Invention

The invention related to a non-operable window frame assembly. The window frame assembly consists of two frame sections which slip into a rectangular hole in the wall; each frame section slips in from opposite sides of the wall. After the two frame sections are installed in the wall opening, a pane of glazing material is placed in the frame. Four pieces of a square molding are used to hold the glazing material in the frame. When screws are placed in the top of the square molding the screws are screwed through both frame sections of the window frame assembly, holding the entire assemblage in place without the need for anchoring clips, making the window frame assembly self anchoring. The size of the glazing material can be up to 36"×36". The height of the molding is a minimum of one inch, making the size of the exposed glazing material up to 34"×34". The entire assemblage comprising the window frame assembly and the glazing material meet Underwriters Laboratories standards with a fire rating "C" label (45 minutes). The miters of the two frame sections are continuously welded at the corners. The window frame assembly can be used for both internal and external walls of varying widths. For installation in an exterior wall, broken glazing material can be replaced from the inside of the building without the need for scaffolding or ladders on the exterior of the structure. The window frame assembly can be manufactured with or without a drywall return.

2. Description of the Related Prior Art

Stark (U.S. Pat. No. 4,259,818, issued Apr. 7, 1981), discloses an improved tamper-proof window unit comprising similar first and second quadrilateral centrally open frame members adapted to be mounted about an opening respectively on opposite sides of a door. Each frame member has a narrow elongated quadrilateral front panel extending generally in a plane parallel to the door and marginally about the door opening with an outer edge portion partially overlapping the door adjacent the opening. However, the prior art invention uses molding screwed in from the side, not the top of the molding as in the present invention.

Kobil et. al (U.S. Pat. No. 2,791,007, issued May 7, 1957) teaches a glass panel mounting sash for doors. It relates to a sash which has provides for clamping engagement with doors of varying thicknesses and which does not require special fastening elements such as threaded screws piercing the door structure to mount it in position. Like the Stark art cited above, this art relates to glass mounting sash for doors, not interior or exterior walls. Also, in art of Kobil, the molding is screwed in from the side, not the top of the molding as in the present invention.

A similar patent of Stark (U.S. Pat. No. 3,969,857, issued Jul. 20, 1976) discloses a tamper-proof window unit comprising similar first and second quadrilateral centrally open frame members adapted to be mounted about an opening respectively on opposite sides of a door. This patent also uses molding screwed in from the side, not from the top. The window unit is designed to be installed in doors.

Riegelman (U.S. Pat. No. 3,768,220, issued Oct. 30, 1973), teaches a metal window subframe and wall structure comprising a base plate having spaced flange plates extending from its outer surface to provide a channel for wall structures. One of such flange plates is at one edge of the plate and has an inner groove in which a sealing strip is anchored. The wall structures are wedged between such strip and the other flange plate. The base plate terminates adjacent to the other edge in a relatively narrow flange plate, which, together with the intermediate plate, provides a dry wall return or receptacle. The inner surface of the base plate intermediate its edges has an integral plate for supporting a window structure. However, in the present invention, the square molding is lacking the inner groove for the sealing strip. Moreover, in the preferred embodiment of Riegelman 220, the metal may be aluminum, which is anodized, and the aluminum is not fire resistant.

Anders (U.S. Pat. No. 4,030,258, issued Jun. 21, 1977) discloses a bullet-proof window for installation in the wall of a banking building to protect a bank teller carrying out banking operations inside the window with visual communication with a customer outside the window. More particularly, the invention relates to a metal frame composed of formed sheet metal sill, head, and side members, in which bullet-proof glass may be installed from outside of the window but clamped from the inside of the window to provide a sealed joint between the glass and frame that is weather-proof and need not be caulked, and is secure against attack by an intruder attempting to remove the bullet-proof glass from outside the building. However, the attaching screws are screwed in from the side, not as through the top of the molding as taught in the present invention.

Kelly (U.S. Pat. No. 2,687,194, issued Aug. 24, 1954) teaches an inside-outside metal trim for window openings, and more particularly to metal trim adapted as a unit into a rough window opening. However, unlike the present invention, which is a two piece system which is inserted from both sides of the wall opening, the art of Kelly discloses a system which is bent up from a single piece of sheet steel for each of the four sides of the window frame.

3. Theory of the Invention

Various configurations of the window frame assembly were subject to testing at Underwriters Laboratories. Prior to the acceptance of the self anchoring fire resistant two piece window frame assembly for UL listing and labeling with a fire rating "C" label (45 minutes), three earlier tests were run at Underwriters Laboratories with test reports issued on Apr. 29, 1988, Mar. 4, 1993, and Mar. 5, 1993. These three earlier tests failed to meet UL listing requirements. It was found that using a square molding of ⅝ inches square or ¾ inches square did not meet UL requirements. It was necessary to increase the size of the square molding to a minimum size of 1 inch by 1 inch in order to provide sufficient resistance to hold the ¼ inch thick wire glass pane in place when a hose stream was directed at the glass at the conclusion of the test.

On Feb. 1, 1996, Underwriters Laboratories issued a test report related to File R4373 to Karpen Steel Products, Weaverville, N.C. The self anchoring fire resistant two piece non-operable window frame assembly meets the fire exposure and hose stream tests for a "C" label (45 minutes) conducted in accordance with the standard, "Fire Tests of Window Assemblies", UL 9 (ANSI/UL9, NFPA 252, ASTM E-152).

Installation of the window frame assembly is done by first inserting the larger of the two frame sections in the rectangular hole in the wall, inserting the smaller frame section from the opposite side, installing the glazing material, and screwing in the four pieces of square molding to hold in the glazing material. When installation is in an exterior wall, the larger section is installed from the outside of the building into the rectangular opening in the wall. By doing so, the possibility is eliminated of water entering the facade of the building, since otherwise water could seep between the seam between the two frame sections or seep through at the attaching screws. Also, if the glazing material is broken, it can be replaced from the inside of the building without the need for ladders or scaffolding on the exterior of the building.

OBJECT AND SUMMARY OF THE INVENTION

The objective of the invention is to provide for a fire resistant window frame assembly that can be easily and quickly installed in an interior or exterior wall, without the use of anchoring clips or other attaching hardware. A rectangular hole is cut in the wall. The two frame sections are inserted into the hole, one frame section from each side of the wall, and the glazing material is inserted into the window frame assembly. The square molding is screwed in from the top of the square molding into the two frame sections.

To accomplish the fire hose stream resistance of the glazing material, the wire glass or fire resistant glazing is held in place between a one inch high, preferably cold rolled steel, galvanized steel, or stainless steel, square molding member, on all four sides of one side of glazing material, and a first frame member, also made of the same material. The first frame member slidably joins a second outer frame member to provide a snug fit for the glazing material.

The window frame insertably slips in place in an open hole in a wall without extra fastening to extra studs, because of its novel structural configuration. The first and second frame members have elbow bends at right angles, so that they can be attached to each other to form a single unit. The one inch high square molding member is attached to the outer frame member so that the glazing material can be held in place between the square molding and the inner frame member.

DESCRIPTION OF THE DRAWINGS

The present invention can be best understood in conjunction with the accompanying drawings.

DETAILED DESCRIPTION OF THE DRAWINGS

Figure 1:
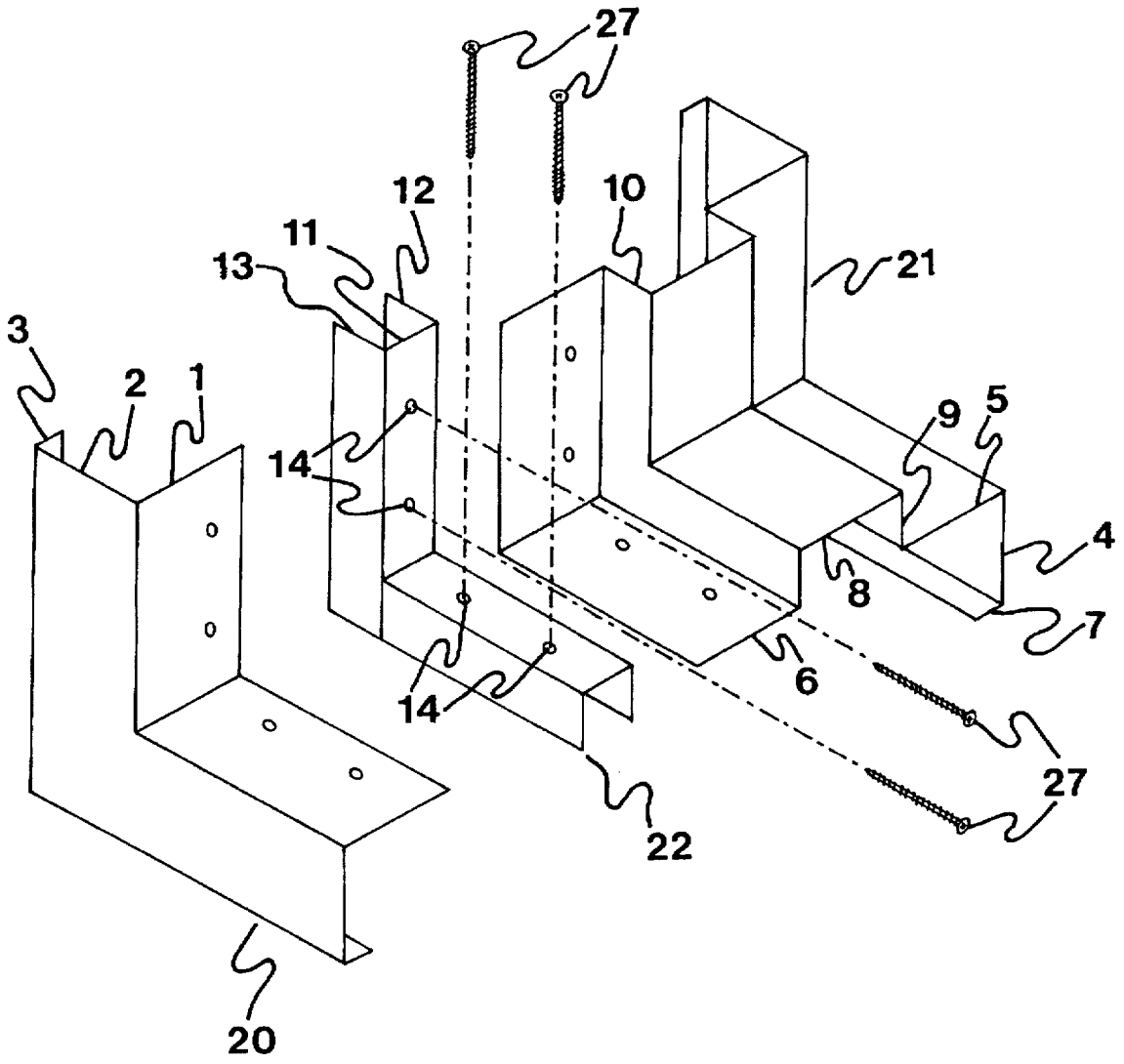
FIG. 1 is a perspective exploded view of the two frame sections of the self anchoring fire resistant two piece non-operable window assembly and the square molding.
Figure 2:
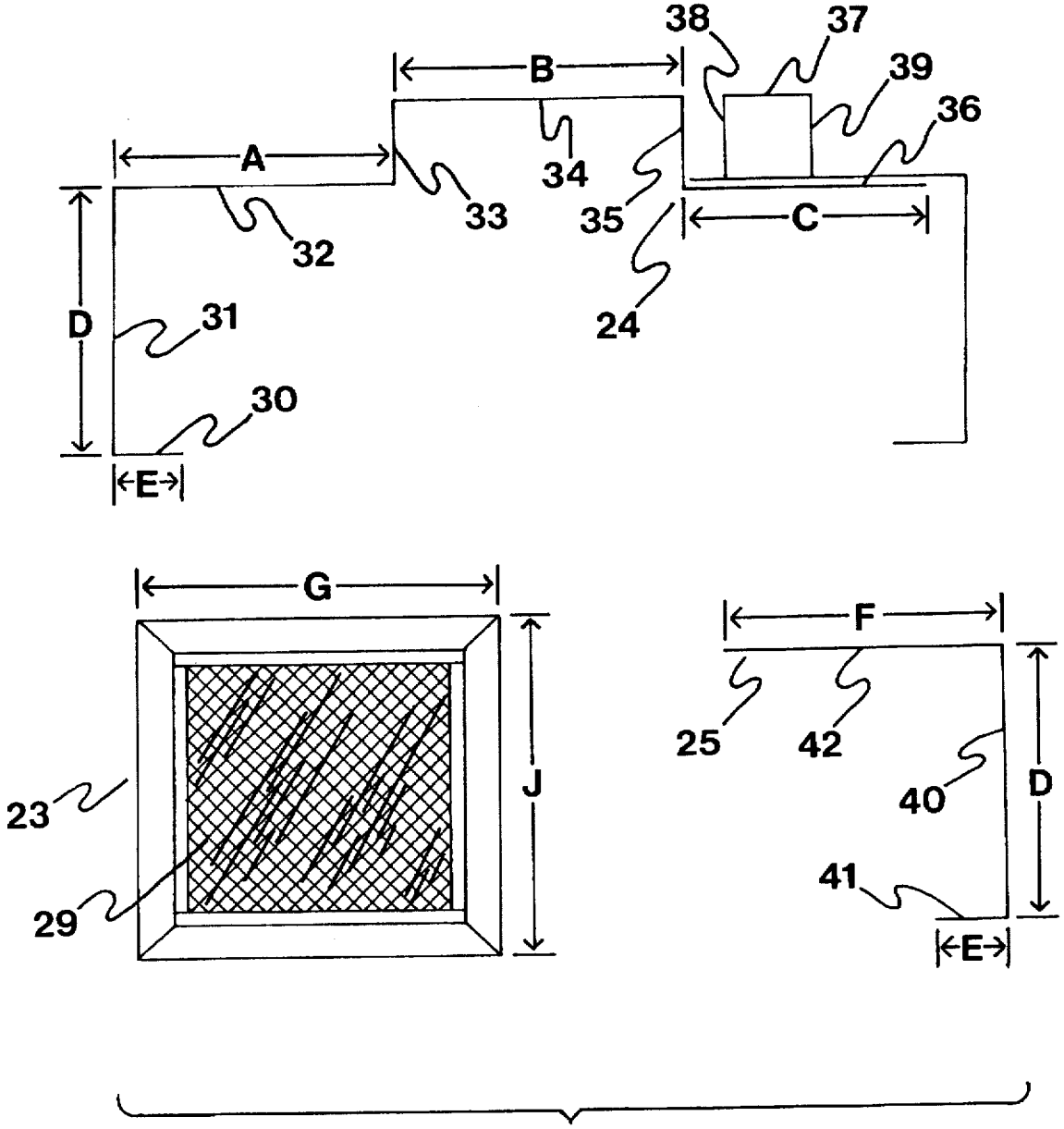
FIG. 2 shows the cross sections of the two frame sections of the window frame assembly, and a frontal view of the window frame assembly providing the maximal dimensions of the glass opening and the exposed glazing material.

FIG. 1 is an exploded perspective view of the two frame sections 20, 21 of the self anchoring fire resistant two piece non-operable window frame assembly and the square molding 22. As shown in FIG. 2, while molding 22 has three faces 37, 38, 39, molding 22 is square in cross section. Each of the two frame sections is generally rectangular in shape, having 4 sides, being bent from sheet metal, either cold rolled sheet steel, galvanized sheet steel, or stainless steel, 16 gauge or thicker, and mitered at the corners.

The smaller of the two frame sections 20, as shown in FIG. 1, shows a portion of the four sides of the frame section. The rabbet 1 is perpendicular to the glazing material (not shown). The face 2 is perpendicular to the rabbet, and the face is parallel to the wall when installed in a structure. The backbend 3 is perpendicular to the face 2, and the backbend is parallel to the rabbet 1. Backbend 3 is bent so as to be opposite rabbet 1. The corner is face welded across the miter and across the rabbet on the back side of the frame section.

The larger of the two frame sections 21 contains a face 4; two rabbets 5,6; a backbend 7; a stop 8; and stop faces 9,10. Face 4, rabbet 5, and backbend 7 are bent as described above for the smaller frame section 20. Perpendicular to the rabbet 5 and parallel to the face 4 is stop face 9. Stop 8 is perpendicular to stop face 9 and is parallel to rabbet 5, being offset. Stop face 10 is perpendicular to stop 8, and stop face 10 is parallel and opposite to Stop face 9. The second rabbet 6 is perpendicular to stop face 9, and its plane is offset by the thickness of the sheet metal from the plane of rabbet 5. The corner is faced welded across the miter and across the rabbet and stop on the back side of the frame section.

The molding has a molding top 11, and square molding faces 12, 13, which are perpendicular to the molding top 11. Molding top 11 of FIG. 1 corresponds to molding top 37 of FIG. 2. Molding side faces 12, 13 of FIG. 1 correspond to molding side faces 38, 39 of FIG. 2. Molding face 12 is opposite molding face 13. Hole 14 is drilled through the square molding top 11, and hole 14 is equidistant from the sides of the square molding top 11 and the molding faces 12, 13. The molding is bent from cold rolled sheet steel, galvanized sheet steel, or stainless steel, 16 gauge or thicker.

FIG. 2 shows the cross sections of the two frame sections of the window frame assembly, and a frontal view of the window frame assembly providing the maximal dimensions of the glass opening and the exposed glazing material. FIG. 2 also indicates typical dimensions.

The frontal view of the window frame assembly 23 is shown. The maximal dimensions of the opening or glazing material is 36"×36". The maximal size of the exposed glazing material is 34"×34". The glazing material 29 can be wire glass, ¼ inch thick or greater in thickness, or another resistant glazing material. The overall side dimensions G and J are 4 inches more than the maximal dimension of the opening.

Cross section 24 provides the typical dimensions of the larger section of the window frame assembly. The height of the square molding face 38, 39 of the molding is a minimum of 1 inch, and the width of the molding top 37 is a minimum of 1 inch. The height of the stop face 35 is a minimum of 1 inch plus the thickness of the cold rolled steel, galvanized steel, or stainless; note that the glazing material (not shown) is placed between the molding face 38 and the stop face 35. Stop face 33, opposite to stop face 35, has a minimum height of 1 inch.

Figure 3:
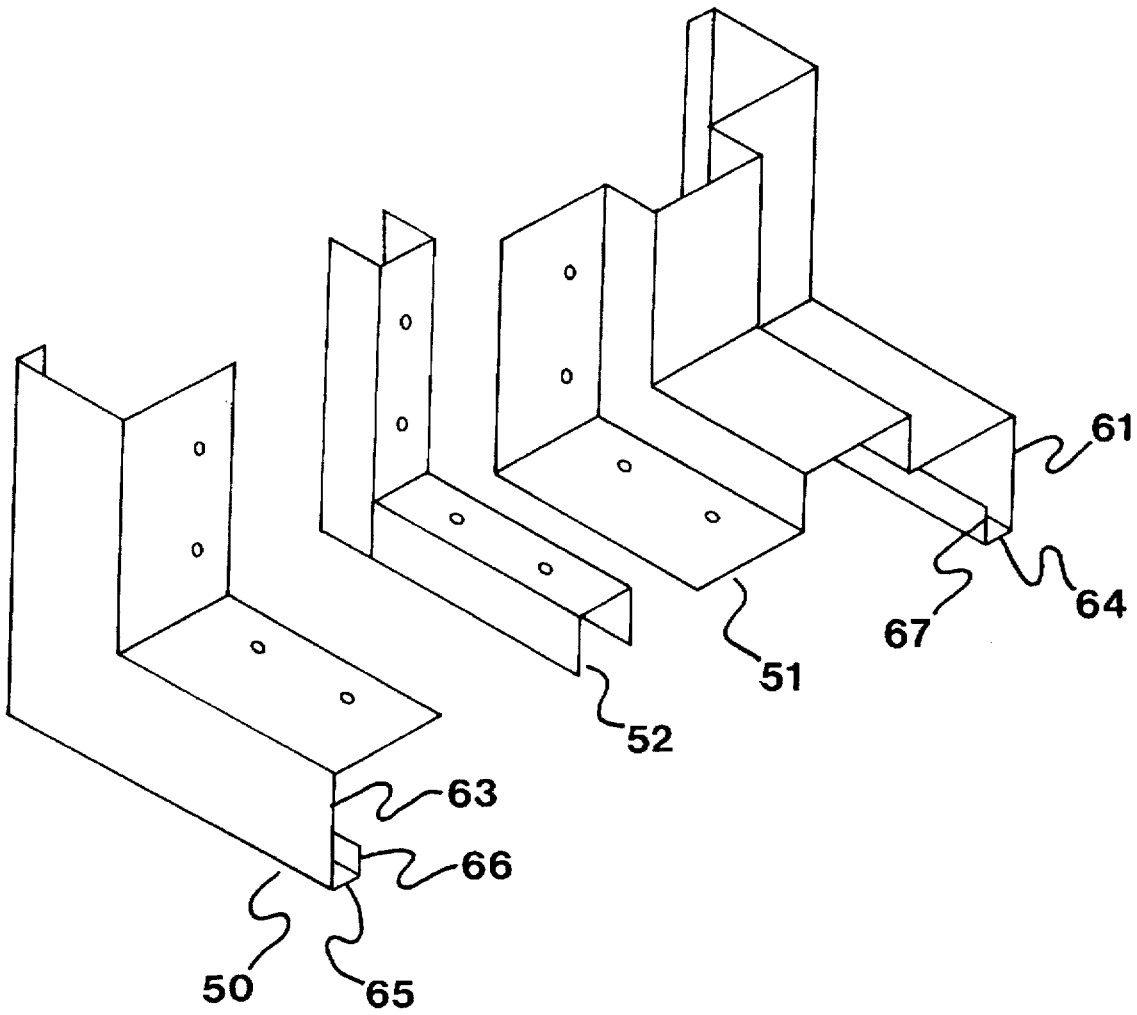
FIG. 3 is a perspective exploded view of the two frame sections of the self anchoring fire resistant two piece non-operable window frame assembly and the square molding, with the addition of a drywall return.

FIG. 3 is an exploded perspective view of the two frame sections 50 and 51 of the self anchoring fire resistant two piece non-operable window frame assembly and the square molding 52. it is the same as in FIG. 1 except that a drywall return 66, 67 is added to both the smaller frame section 50 and the larger frame section 51. The drywall return 67 is bent perpendicular to the backbend 64 in the larger frame section 51; it is opposite the face 61. In the smaller frame section 50, the drywall return 66 is perpendicular to the backbend 65 and the opposite face 63.

Figure 4:
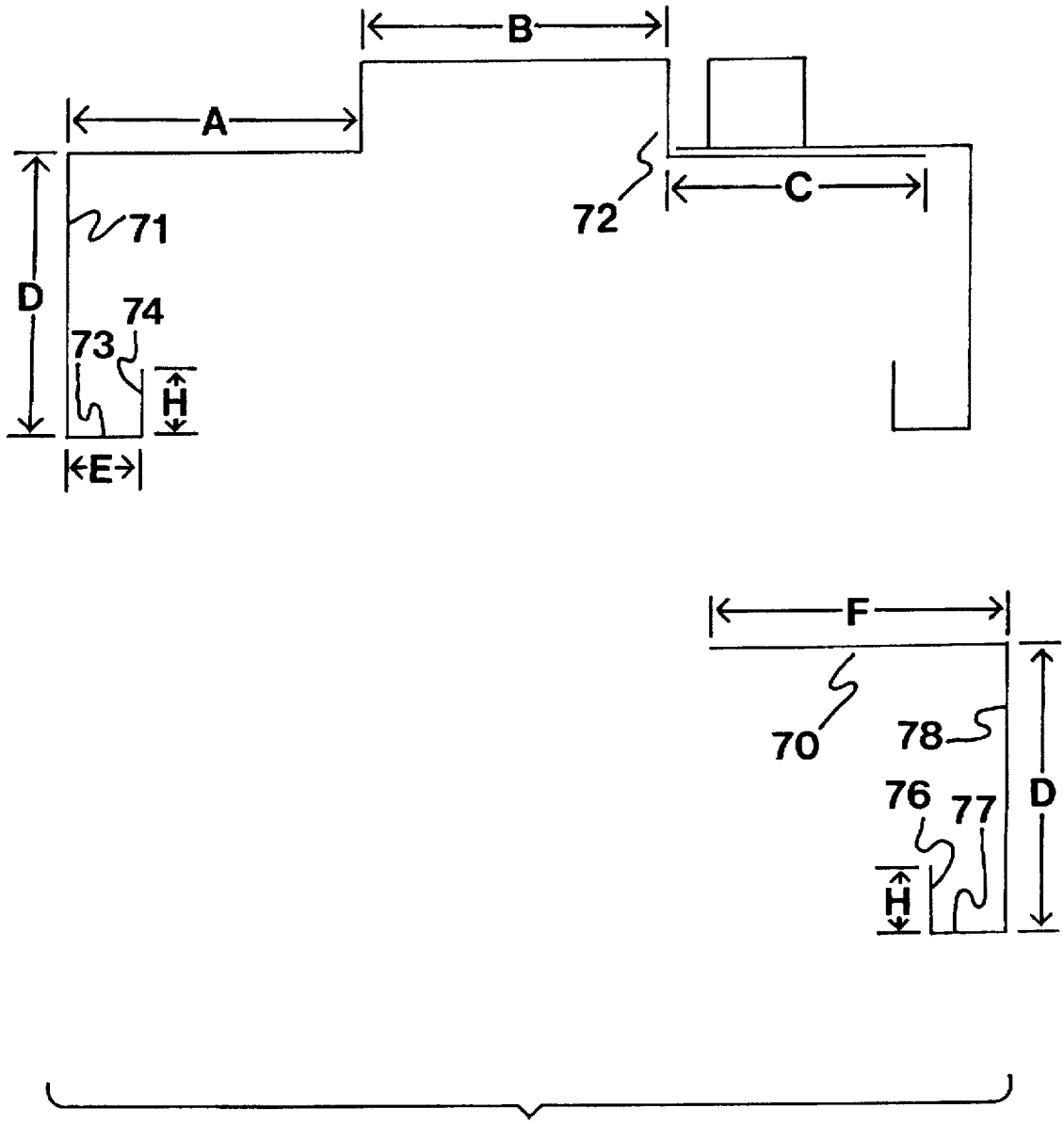
FIG. 4 shows the cross sections of the two frame section of the window frame assembly, and a frontal view of the window frame assembly providing the maximal dimensions of the glass opening and the exposed glazing material for a window frame assembly with a drywall return.

FIG. 4 shows the cross sections of the two frame sections of the window frame assembly; it is the same as the cross sections shown in FIG. 2 except that a drywall return 74, 76 has been added to both the smaller frame section 70 and the larger frame section 72. The drywall return 74 is bent perpendicular to the backbend 73 in the larger frame section 72; it is opposite the face 71. The dimension H of the drywall return 74 is typically ½ inch. In the smaller frame section 70, the drywall return 76 is perpendicular to the backbend 77 and opposite face 78. The dimension H of the drywall return 76 of the smaller frame section 70 is typically ½ inch.

When the two frame sections are assembled together, the plane of the rabbet in the smaller frame section is in the same plane as the exposed rabbet in the larger frame section; the exposed rabbet is between the face and the stop face. The window frame assembly can be used for walls of varying widths by changing the dimensions of the rabbets and the stop. Dimension A is the width of the rabbet 32. Dimension B is the width of the stop 34. A typical dimension of the stop 34 as manufactured for installation may be 1⅞ inches. A typical dimension of the rabbet 32 may be 1¹⁵⁄₁₆ inches. Dimension D is the dimension of the face 31; this dimension is typically two inches. Dimension E is the dimension of the backbend 30; it is typically ½ inch.

Cross section 25 provides the typical dimensions of the smaller frame section of the window frame assembly. Dimension D is the dimension of the face 40; as is in the larger frame section, it is typically two inches. Dimension E is the dimension of the backbend 41; it is typically ½ inch. Dimension F is the dimension of the rabbet 42. Note that the dimension F of the rabbet 42 of the smaller frame section 25 is typically ⅛ inch larger than the dimension C of the rabbet 36 of the larger frame section 24. Fasteners 27 such as pan head, oval, self-tapping screws, number 8, 18 threads to the inch, 2 inches long or longer, or screws of larger size, are typically used to attach the square molding to the two frame sections. The screws are inserted from the molding top, and go through both frame sections to hold them in place in the rectangular opening in the wall, making the window frame assembly self anchoring. Typically, the screws are located two inches from each end and 6 inches on center.

In the preferred embodiment self-tapping screws may be used to hold the assemblage together, and hole 14 is pre-drilled only in the square molding 22 prior to field assembly, with fastener 27 passing through the smaller section 20 and then the larger section 21.

Modifications can be made to the method for making the device, the device itself as well as the process described in the self anchoring fire resistant two piece non-operable window frame assembly without departing from the spirit and scope of the invention as exemplified below in the appended claims.

I claim:

1. A self anchoring fire resistant two piece non-operable window frame assembly, wherein said window frame assembly is adapted to resist a fire extinguishing hose stream directed for a minimum of 45 minutes against a minimum ¼ inch thick glazing material in said window frame assembly, comprising two frame sections, including a first frame section and a second frame section, each said frame section adapted to slip in from opposite sides of a rectangular hole in a wall, glazing material, a square molding, said square molding having a square configuration in cross section, said square molding adapted to hold said glazing material in place in said window frame assembly, at least one fastener adapted to attach said square molding to said first and said second frame sections;

a means for resisting the fire extinguishing hose stream directed for a minimum of 45 minutes against a minimum ¼ inch thick glazing material in said window frame assembly, said means comprising said square molding being of steel and said square molding having respective side faces of at least one inch in height and a top connecting side faces, said top being at least one inch in width, and, said self anchoring fire resistant two piece frame assembly being rectangular in shape with four sides.

2. The window frame assembly as in claim 1, wherein said first frame section is rectangular in shape with four sides, each side being bent from flat cold rolled sheet steel having a gauge of at least 16 gauge, with each side having a cross section comprising a rabbet, a face, and a backbend; said rabbet being perpendicular to said face; said face being perpendicular to said backbend; said backbend parallel to and being opposite said rabbet.

3. The window frame assembly as in claim 2, wherein said flat cold rolled sheet steel is galvanized sheet steel.

4. The window frame assembly as in claim 2, wherein said second frame section is rectangular in shape with four sides, each side bent from flat cold rolled sheet steel having a gauge of at least 16 gauge, each side having a cross section comprising a face, two rabbets, a backbend, a stop, and two stop faces; said backbend being perpendicular to said face; a first rabbet being perpendicular to said face, said first rabbet being parallel to and being opposite said backbend; a first stop face being perpendicular to said rabbet and being parallel to said face, said first stop being offset; a further stop being perpendicular to said stop face and being parallel to said first rabbet, said further stop being offset; a second stop face being perpendicular to said further stop, said second stop face being opposite said first stop face; and a second rabbet being perpendicular to said stop face, being offset, with a thickness of flat cold rolled sheet steel, from a plane of said first rabbet.

5. The window frame assembly as in claim 4, wherein said second frame section is made of flat cold rolled sheet steel, said sheet steel being galvanized sheet steel.

6. The window frame assembly as in claim 2, wherein said first frame section is mitered and is face welded across miters and across said rabbet on a back side, of said first frame section.

7. The window frame assembly as in claim 4, wherein said second frame section is mitered and is faced welded across miters and across said rabbet and said stop on a back side of said second frame section.

8. The window frame assembly as in claim 1, wherein said square molding, is bent from flat cold rolled sheet steel having a gauge of at least 16 gauge, with two molding faces and a molding top, each said molding face being perpendicular to said molding top, said two molding faces being parallel and opposite each other.

9. The window frame assembly as in claim 8, wherein said square molding has holes for attaching fasteners, said holes being drilled through said molding top.

10. The window frame assembly as in claim 8, wherein said square molding is galvanized sheet steel.

11. The window frame assembly as in claim 1, wherein said glazing material is wire glass having a thickness of at least ¼ inch thick.

12. The window frame assembly as in claim 1, wherein said glazing material is fire resistant.

13. The window frame assembly as in claim 11, wherein said glazing material has a size being up to 36"×36".

14. The window frame assembly as in claim 12, wherein said glazing material has a size being up to 36"×36".

15. The window frame assembly as in claim 11, wherein said glazing material has an exposed portion having maximum dimensions 34"×34".

16. The window frame assembly as in claim 12, wherein said glazing material has an exposed portion having maximum dimensions 34"×34".

17. The window frame assembly as in claim 2, wherein said first frame section is flat cold rolled sheet steel and is stainless steel.

18. The window frame assembly as in claim 4, wherein said second frame section is flat cold rolled sheet steel and is stainless steel.

19. The window frame assembly as in claim 8, wherein said molding is flat cold rolled sheet steel and is stainless steel.

20. The window frame assembly as in claim 1, wherein said fasteners are screws.

21. The window frame assembly as in claim 2, wherein said first frame section includes a drywall return, said drywall return being perpendicular to said backbend and being located opposite said face.

22. The window frame assembly as in claim 4, wherein said second frame section includes a drywall return, said drywall return being perpendicular to said backbend and being located opposite said face.

23. The window frame assembly as in claim 1 wherein said self anchoring fire resistant two piece non-operable window frame assembly is adapted to be installed in walls of varying widths.

24. The window frame assembly as in claim 2, wherein said rabbet in first frame section and said rabbet between said first face and said stop face in said second frame section are in the same plane when said first frame section and second frame section are installed in a rectangular hole in a wall.

* * * * *